United States Patent [19]

Cormier, Sr. et al.

[11] Patent Number: 4,662,917

[45] Date of Patent: May 5, 1987

[54] PROCESS FOR THE SEPARATION OF AIR

[75] Inventors: Thomas E. Cormier, Sr.; Rakesh Agrawal, both of Allentown, Pa.

[73] Assignee: Air Products and Chemicals, Inc., Allentown, Pa.

[21] Appl. No.: 869,143

[22] Filed: May 30, 1986

[51] Int. Cl.[4] ..... F25J 5/00

[52] U.S. Cl. ..... 62/13; 62/39; 62/43

[58] Field of Search ..... 62/11, 13, 31, 38, 39, 62/43

[56] References Cited

U.S. PATENT DOCUMENTS

| | | | |
|---|---|---|---|
| 2,627,731 | 2/1953 | Benedict | 62/34 |
| 2,982,108 | 5/1961 | Grunberg et al. | 62/28 |
| 3,492,828 | 2/1970 | Ruckborn | 62/13 |
| 3,736,762 | 6/1973 | Toyama et al. | 62/13 |
| 4,222,756 | 9/1980 | Thorogood | 62/13 |
| 4,303,428 | 12/1981 | Vandenbussche | 62/38 |
| 4,400,188 | 8/1983 | Patel et al. | 62/13 |
| 4,410,343 | 10/1983 | Ziemer | 62/43 |
| 4,464,188 | 8/1984 | Agrawal et al. | 62/13 |

*Primary Examiner*—Ronald C. Capossela

*Attorney, Agent, or Firm*—Willard Jones, II; James C. Simmons; E. Eugene Innis

[57] ABSTRACT

A process is set forth for the separation of air by cryogenic distillation in a single column to produce a nitrogen product and an oxygen-enriched product. In the process, at least a portion of the nitrogen product is compressed and recycled to provide reboil at the bottom of the distillation column and to provide some additional reflux to the upper portion of the column. In addition, part of the compressed air stream is expanded to provide work, which is used to drive an auxiliary compressor for recycle nitrogen stream compression.

18 Claims, 3 Drawing Figures

PROCESS FOR THE SEPARATION OF AIR

TECHNICAL FIELD

The present invention is directed to the separation of air into its constituents, nitrogen and oxygen. Specifically, the invention is directed to the cryogenic distillation of air to produce a nitrogen product and an oxygen-enriched product.

BACKGROUND OF THE PRIOR ART

The prior art has recognized the need to perform air separation, particularly for the recovery of nitrogen with greater efficiency. With the increasing cost of energy and the need for large quantities of separated gas such as nitrogen for enhanced petroleum recovery, highly efficient separation processes and apparatus are necessary to provide competitive systems for the separation and production of the components of air, most particularly nitrogen.

In U.S. Pat. No. 2,627,731 a process for the rectification of air into oxygen and nitrogen is described wherein a two sectioned or single distillation column are used alternatively. Air is cooled by heat exchange and introduced directly into the distillation column. A nitrogen product is removed from the overhead of the column and a portion is compressed in two stages. The first stage nitrogen compressed stream is recycled in order to reboil and condense a portion of the midpoint of the column by indirect heat exchange before being introduced into the overhead of the column as reflux. A second stage compressed nitrogen stream is recycled and partially expanded to provide refrigeration. This expanded stream is recycled to the nitrogen product line. The remaining stream of the second stage compressed nitrogen stream reboils the bottom of the column before being combined with the first stage compressed nitrogen stream and introduced into the overhead of the column as reflux.

In U.S. Pat. No. 2,982,108, an oxygen producing air separation system is set forth wherein a portion of the nitrogen generated from the distillation column is compressed and reboils the base of a high pressure section of the column before being introduced as reflux to low pressure section of the column. The feed air stream is supplied in separate substreams into the high pressure section of the column and in an expanded form into the low pressure section of the column.

U.S. Pat. No. 3,492,828 discloses a process for the production of oxygen and nitrogen from air wherein a nitrogen recycle stream is compressed and condensed in a reboiler in the base of a distillation column before being reintroduced into the column as reflux. A portion of the nitrogen recycle stream may be expanded in which the power provided by the expansion drives the compressor for the main nitrogen recycle stream.

In U.S. Pat. No. 3,736,762, a process for producing nitrogen in gaseous and liquefied form from air is set forth. A single distillation column is refluxed with nitrogen product condensed in an overhead condenser operated by the reboil of oxygen conveyed from the bottom of said column. At least a portion of the oxygen from the overhead condenser is expanded to produce refrigeration for the separation.

In U.S. Pat. No. 4,222,756, a process is set forth in which a two pressure distillation column is used in which both pressurized column sections are refluxed with an oxygen-enriched stream. The low pressure column is fed by a nitrogen-enriched stream from the high pressure column which is expanded to reduce its pressure and temperature.

U.S. Pat. No. 4,400,188 discloses a nitrogen production process wherein a single nitrogen recycle stream refluxes a distillation column which is fed by a single air feed. Waste oxygen from the column is expanded to provide a portion of the necessary refrigeration.

In U.S. Pat. No. 4,464,188 a process and apparatus is set forth for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

Although the prior art has taught numerous systems for the separation of air and particularly the production of a nitrogen product from air, these systems have been unable to achieve the desired efficiencies in power consumption and product recovered which are necessary in the production of large volumes of air components, such as nitrogen.

BRIEF SUMMARY OF THE INVENTION

The present invention is directed to a system for the separation of air by cryogenic distillation in a single distillation column which comprises compressing a feed air stream to an elevated pressure and aftercooling the pressurized air stream. Water and carbon dioxide are removed, preferably in a molecular sieve unit. The feed air stream is split into two substreams. The first substream is cooled in heat exchange against other process streams before it is introduced into a distillation column. The second substream is compressed, cooled in heat exchange against process streams and expanded to recover work. The expanded substream is further cooled and used to reboil the distillation column before being reduced in pressure and introduced into the column as reflux. A nitrogen product stream and an oxygen-enriched stream are separated and removed from said distillation column. A portion of the nitrogen product stream is condensed against the oxygen-enriched stream and returned it to the column as reflux. The remaining nitrogen product is rewarmed stream by heat exchange against process streams. At least a portion of the product stream is compressed to an elevated pressure. A nitrogen recycle stream is split from the compressed nitrogen product stream, further compressed, cooled and used to reboil the distillation column before being reduced in pressure and introduced into the column as reflux.

Two variations on the above scheme are possible. In the first variation, two nitrogen recycle streams are split off instead of one. The first nitrogen recycle stream is cooled and used to reboil the distillation column before it is reduced in pressure and introduced it into the column as reflux. The second nitrogen recycle stream is further compressed, cooled, and used to reboil the distillation column in an additional reboiler before it is reduced in pressure and mixed with the first nitrogen recycle stream and introduced into the column.

In the second variation, the second feed air substream is compressed, cooled in heat exchange against process streams, expanded to recover work and further cooled. Instead of reboiling the column with the second substream, it is combined with the first feed air substream, and introduced into an intermediate location in the column. Also, two nitrogen recycle streams are split off instead of one. The first nitrogen recycle stream is cooled and used to reboil the distillation column before it is reduced in pressure and introduced into the column as reflux. The second nitrogen recycle stream is further compressed, cooled and used to reboil the distillation column before it is reduced in pressure and mixed with the first nitrogen recycle stream and introduced into the column.

Preferably, in all of the above described configurations, the oxygen-enriched stream from the bottom of the distillation column is flashed through a JT valve before introduction into the outer shell of the condenser of the distillation column in order to reduce its temperature and pressure. Additionally, the oxygen-enriched product stream can be used to reactivate the molecular sieve dryer.

Advantageously, the molecular sieve dryer is comprised of a pair of switching adsorption beds in which both beds are packed with a molecular sieve material and used alternately for adsorption and regeneration.

DETAILED DESCRIPTION OF THE INVENTION

Figure 1:
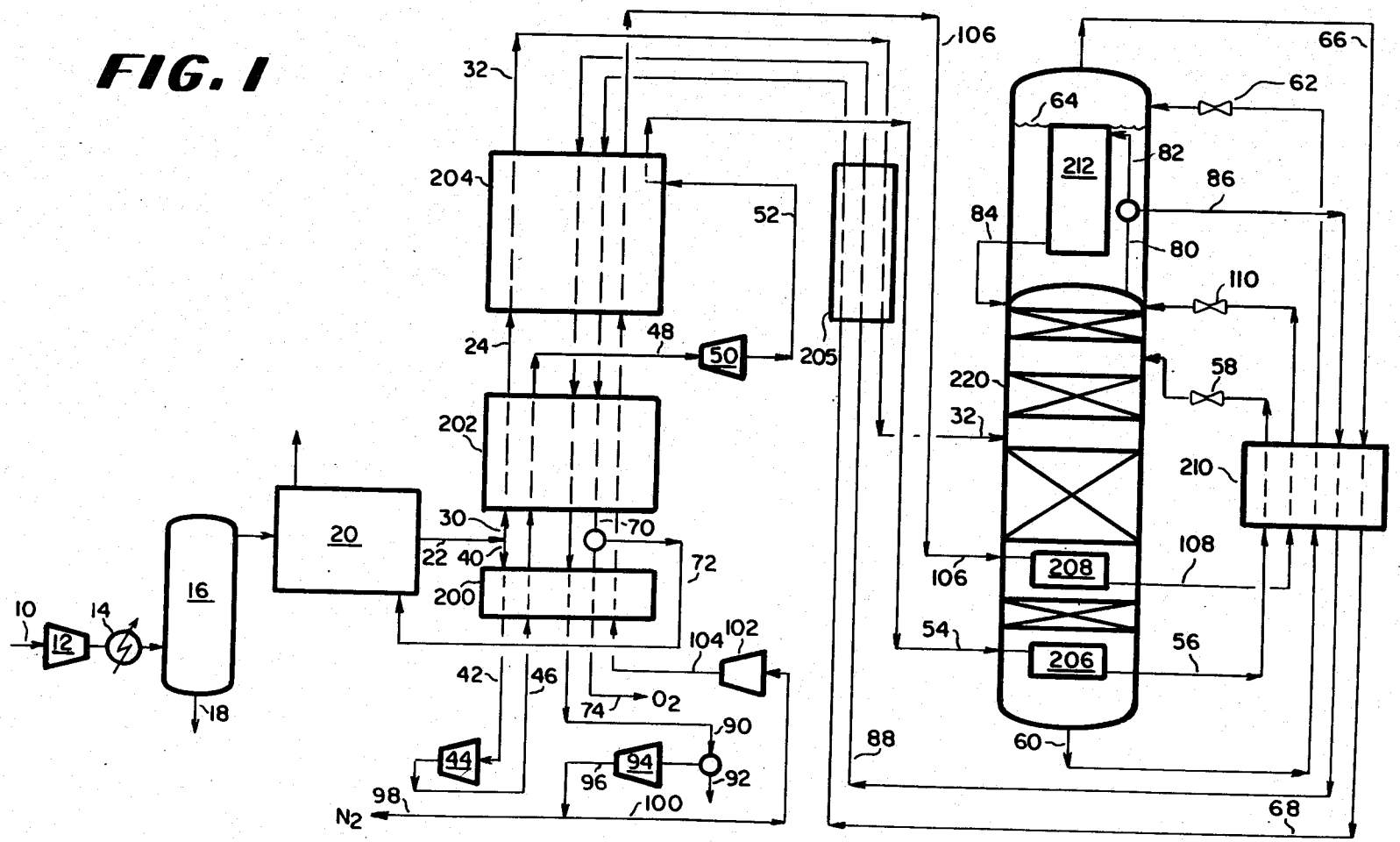
FIG. 1 is a schematic flow scheme of a preferred embodiment of the present invention.

The present invention will now be described in greater detail with respect to a preferred embodiment of the invention and two variations of it. With reference to FIG. 1, a feed air stream is introduced into the system in line 10 and is compressed to an elevated pressure in the main air compressor 12. The heat of compression is removed from the air stream by heat exchange against an external cooling fluid, such as water at ambient conditions, in heat exchanger or aftercooler 14. The high pressure aftercooled feed air stream is then introduced into a knock-out drum 16 wherein condensed water and other heavy components, such as hydrocarbons, are removed as a liquid phase in drain line 18. Most of the condensables are removed in this apparatus, but residual moisture and carbon dioxide are still entrained in the feed air stream. To remove the residual water and carbon dioxide, the feed air stream is directed through a molecular sieve bed 20. The molecular sieve bed is preferably a pair of adsorption beds which are packed with a molecular sieve adsorbent. While one bed is in the adsorption stage removing water and carbon dioxide from the feed air stream, the other bed is in a regeneration stage in which a dry regeneration gas, preferably a process stream, such as a waste oxygen-enriched stream, is passed through the regenerating adsorption bed to remove adsorbed water and carbon dioxide. The duty on the beds is switched in a timed sequence corresponding to the adsorption capacity of the beds. Such an apparatus is generally referred to as a dryer and is known in the art specifically as switching adsorption beds.

The compressed and dried feed air stream in line 22 is then separated into two substreams, a first feed air substream 30, and a second feed air substream 40. The first feed air substream 30 is cooled by heat exchange in heat exchangers 202, 204 and 205 against process streams. This feed air substream is introduced into a single pressure distillation column 220 at an intermediate level. The second feed air substream in line 40 is warmed in heat exchanger 200 against process streams, compressed to an elevated pressure in compressor 44 and cooled in heat exchangers 200 and 202; it emerges from exchanger 202 as line 48. This second cooled feed air substream 48 is then expanded in expander 50 to produce work for refrigeration and compression. The exhaust from expander 50, line 52, is further cooled in exchanger 204. The substream in line 52 is then used to reboil distillation column 220 in an reboiler 206 which is located near the bottom of the column 220. The substream, line 54, is condensed in the reboiler 206 as the substream heat exchanges with the bottoms liquid which is reboiled to send vapors upward through the column. The condensed substream is removed from the reboiler 206 in line 56 and is further cooled in subcooling heat exchanger 210 before being flashed through a JT valve 58 to a lower temperature and pressure before being introduced into distillation column 220 above the feed inlet of the remaining air stream.

An oxygen-enriched stream is removed from the bottom of the column 220 in line 60. This stream contains approximately 50 to 80% oxygen depending upon the overall nitrogen recovery of the system. The oxygen-enriched stream in line 60 is further cooled in subcooling heat exchanger 210 before being flashed to a reduced temperature and pressure through JT valve 62 and introduced into the sump outside the column condenser 212. This oxygen-enriched stream 64 in heat exchange with the condenser 212 is reboiled against a portion of the nitrogen product stream removed from the top of the column in line 80. A nitrogen product stream is removed from the top of the column in line 86, while a nitrogen reflux stream is directed in line 82 through the condenser 212 to be condensed against the reboiling oxygen-enriched stream 64 and reintroduced into distillation column 220 by line 84 as a reflux stream for distillation column 220.

The vaporized oxygen-enriched stream from the sump outside the condenser 212 of distillation column 220 is removed in line 66 and rewarmed against process streams in subcooling heat exchanger 210. The warmed oxygen-enriched stream in line 68 is then further rewarmed against process streams in heat exchanger 205, 204, 202 and 200. A portion of the oxygen-enriched stream is removed before passage through heat exchanger 200 in line 72 and is used to regenerate the dryer 20, specifically, the regeneration of the molecular sieve bed presently in the regeneration stage. This gas, the oxygen-enriched stream, is essentially free of water and carbon dioxide and readily desorbs such components from the adsorbent material in the bed during the regeneration sequence. The spent regeneration gas may then be vented or used for utility requiring oxygen enrichment where water and carbon dioxide do not present a problem. The remaining oxygen-enriched stream passes through heat exchanger 200 and is further rewarmed before leaving the system in line 74. Again, the oxygen-enriched stream in line 74 may be used for utilities requiring oxygen-enrichment, but this stream is also free of water and carbon dioxide. Alternately, the stream may be vented to atmosphere.

The nitrogen product stream removed from stream 80 in line 86 contains essentially pure nitrogen which is rewarmed in subcooling heat exchanger 210 against process streams. The nitrogen product stream now in line 88 is further rewarmed by heat exchange against process streams in heat exchanger 205, 204, 202 and 200. The nitrogen product stream now in line 90 can be used in part for reactivation or purge duty in the system or a product at low pressure by removing a stream in line 92. The other portion of the nitrogen product stream in line 90 is then compressed to an elevated pressure in compressor 94. The elevated pressure level nitrogen product stream in line 96 is then split into a nitrogen recycle stream 100 and a pressurized nitrogen product stream in line 98. This vaporized nitrogen product stream in line 98 can be further compressed to provide a nitrogen product stream at an even higher pressure.

The nitrogen recycle stream in line 100 is further compressed in compressor 102 and is then cooled by heat exchange against process streams in heat exchangers 200, 202 and 204 and emerges as stream 106. The nitrogen recycle stream in line 106 is then introduced into the recycle reboiler 208 situated in the lower portion of distillation column 220, above the reboiler 206. The recycle stream reboils the rectifying streams in the column while condensing the nitrogen recycle stream which is removed in line 108. The combined nitrogen recycle stream is then subcooled in subcooling heat exchanger 210 against process streams. The subcooled combined nitrogen recycle stream is reduced in temperature and pressure by passage through a JT valve 110 before being introduced into the top of distillation column 220 as reflux.

Although not shown, a liquid stream may be withdrawn from the sump of condenser 212 and passed through a guard adsorber to prevent hydrocarbon buildup. This stream then would pass through a heat pump and re-enter the sump of condenser 212. A small liquid purge would also be taken off the sump of condenser 212 for the same purpose.

This process is particularly attractive because it utilizes expansion of a part of the pressurized feed air stream to provide both refrigeration and compression. Efficient utilization of the power derived from this expansion is realized by the use of the expander generated power in the compressor of the feed substream 100. The expander 50 and the compressor 102 can be interconnected in any known manner, such as by an electrical connection between an expander power generator and an electric motor driven compressor, or preferably by the mechanical linkage of the expander to the compressor in what is known in the art as a compander. This provides particularly efficient utilization of the power provided in the expander in the compression of the nitrogen recycle stream in the compressor 102. The present invention will now be further described with reference to an example of air separation for the recovery of nitrogen gas at high pressure.

Figure 2:
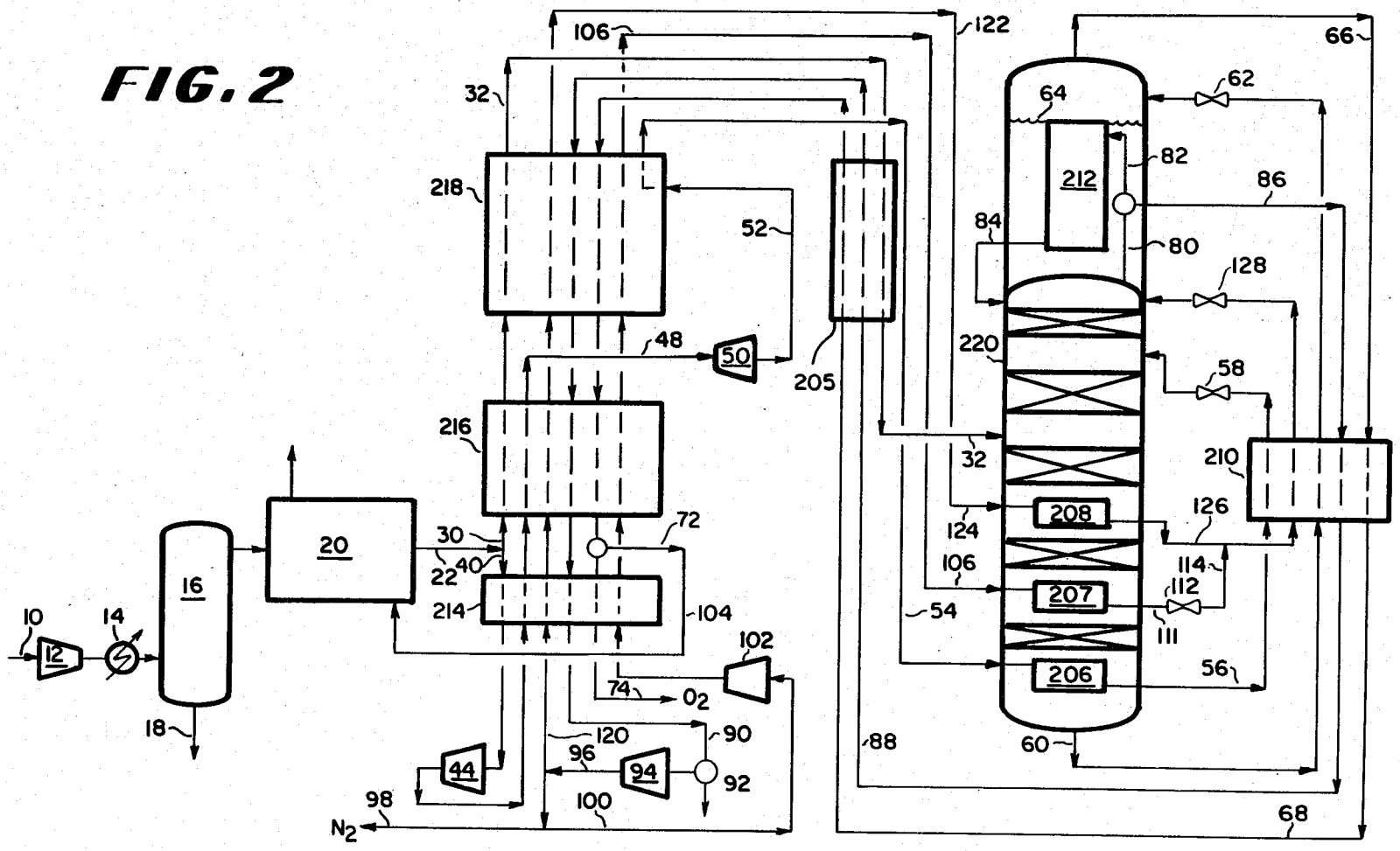
FIG. 2 is a schematic flow scheme of a first alternative to the preferred embodiment of the present invention.
Figure 3:
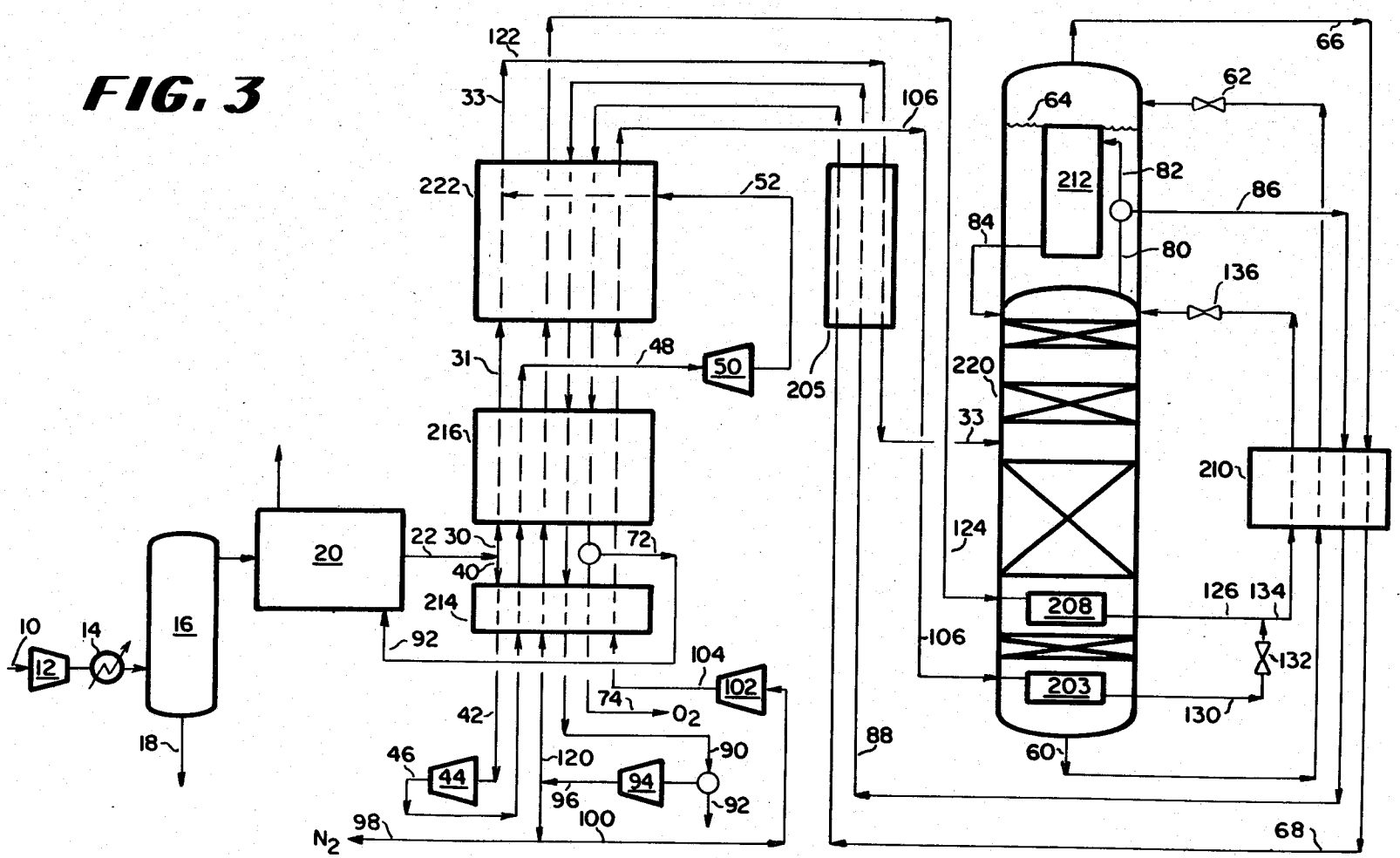
FIG. 3 is a schematic flow scheme of a second alternative to the preferred embodiment of the present invention.

Two variations on the above preferred embodiment are shown in FIG. 2 and FIG. 3. In FIG. 2, the elevated pressure level nitrogen product stream in line 96 is then split into a first nitrogen recycle stream 100, a second nitrogen recycle stream 120, and a pressurized nitrogen product stream in line 98. The first nitrogen recycle stream in line 100 is further compressed in compressor 102 and is then cooled by heat exchange against process streams in heat exchangers 214, 216 and 218 and emerges as stream 106. The nitrogen recycle stream in line 106 is then introduced into a first nitrogen recycle reboiler 207 situated in the lower portion of distillation column 220, above the reboiler 206. The first nitrogen recycle stream reboils the rectifying streams in the column while condensing the nitrogen recycle stream which is removed in line 111. The the condensed first nitrogen recycle stream in line 111 is expanded in expander 112 and is combined line 114 with stream 126. The second nitrogen recycle stream 120 is cooled in heat exchangers 214, 216, and 218. The cooled second nitrogen recycle stream is introduced into a second nitrogen recycle reboiler 208 situated in the lower portion of distillation column 220, above first nitrogen recycle reboiler 207. The second recycle nitrogen reboiler 208 is in a cooler portion of distillation column 220 which allows for a lower nitrogen recycle stream pressure than in first nitrogen recycle reboiler 207. The first recycle stream reboils the rectifying streams in the column while condensing the nitrogen recycle stream which is removed in line 126 and combined with stream 114. The combined nitrogen recycle stream is then subcooled in subcooling heat exchanger 210 against process streams. The subcooled combined nitrogen recycle stream is reduced in temperature and pressure by passage through a JT valve 128 before being introduced into the top of distillation column 220 as reflux. The remainder of the process is the same as that depicted in FIG. 1.

In FIG. 3, air stream 52 is combined with air stream 31 and is introduced to distillation column 220 in line 33 instead of being used as a working fluid for reboil. In addition, similar to FIG. 2, the elevated pressure level nitrogen product stream in line 96 is then split into a first nitrogen recycle stream 100, a second nitrogen recycle stream 120, and a pressurized nitrogen product stream in line 98. The first nitrogen recycle stream in line 100 is further compressed in compressor 102 and is then cooled by heat exchange against process streams in heat exchangers 214, 216 and 222 and emerges as stream 106. The nitrogen recycle stream in line 106 is then introduced into a first recycle reboiler 203 situated in the lowest portion of distillation column 220. The first nitrogen recycle stream reboils the rectifying streams in the column while condensing the nitrogen recycle stream which is removed in line 130. The condensed first nitrogen recycle stream in line 130 is expanded in expander 132 and is combined with stream 126. The second nitrogen recycle stream 120 is cooled in heat exchangers 214, 216, and 222. The cooled second nitrogen recycle stream is introduced into a second recycle reboiler 208 situated in the lower portion of distillation column 220, above first nitrogen recycle reboiler 203. The second recycle reboiler 208 is in a cooler portion of distillation column 220 which allows for a lower recycle stream pressure than in first nitrogen recycle reboiler 203. The second nitrogen recycle stream reboils the rectifying streams in the column while condensing and is removed in line 126 and combined with the stream from expander 132. The combined nitrogen recycle stream 134 is then subcooled in subcooling heat exchanger 210 against process streams. The subcooled combined nitrogen recycle stream is reduced in temperature and pressure by passage through a JT valve 136 before being introduced into the top of distillation column 220 as reflux. The remainder of the process is the same as that depicted in FIG. 1.

The present invention will now be further described with reference to an example of air separation for the recovery of nitrogen gas at high pressure.

EXAMPLE

With reference to the preferred embodiment, FIG. 1, a feed air stream is introduced in line 10 into the air separation apparatus and compressed and aftercooled to a pressure of about 68 psia and a temperature of 7° C. Approximately 85% of the feed air after drying is passed through the heat exchangers 202, 204 and 205 in line 24 and cooled to a temperature of −172° C. before being introduced as feed into distillation column 220 for rectification at a pressure of about 62 psia. About 15% of the feed air is split from the feed stream and is removed as a feed air substream in line 40. The line 40 substream is warmed in exchanger 200 to about 16.5° C. and compressed in compressor 44 to a pressure of 375 psia. The substream is cooled in exchangers 200 and 202 to a temperature of about −121° C. The cooled substream is expanded in expander 50 to a pressure of 101 psia and is further cooled prior to being introduced into reboiler 206 at about −169° C. as vapor. This substream reboils the column while being condensed and leaves the reboiler at about −173° C. It is then cooled in the exchanger 210 and introduced into the column 220 as a second feed at approximately −179° C. An oxygen-enriched stream containing 67% oxygen is removed from the base of the column, is cooled, reduced in pressure and introduced into the overhead of the column outside the shell of the overhead condenser to condense a nitrogen reflux stream. The liquid oxygen is at approximately −187° C. Gaseous oxygen is then removed in line 66. A pure nitrogen product having 2 ppm of oxygen is removed in line 86 and is rewarmed before being compressed at 94 to about 112 psia. About 33% of the product is recycled in line 100, while the remaining nitrogen product is removed from the system. The system, as run, provides gaseous nitrogen at pressure, approximately 112 psia, and recovers approximately 88% of the total nitrogen processed by the system. To maintain the same evaluation basis, the nitrogen product is further compressed, not shown, to 213 psia.

The present invention provides a favorable improvement over known nitrogen generating air separation systems. As shown in Table 1 below, the present invention provides nitrogen at a reduced power requirement over a commonly assigned patented cycle disclosed in U.S. Pat. Nos. 4,400,188 and 4,464,188. The calculated power reduction of 1.2% is believed to be a significant reduction in air separation systems.

TABLE 1

| | U.S. Pat. No. 4,400,188 | U.S. Pat. No. 4,464,188 | PRESENT INVENTION |
|---|---|---|---|
| Power Required: KWH/NM$^3$ | 0.230 | 0.221 | 0.218 |
| Percent Improvement: | — | — | 1.2 |

The basis of the evaluation was at 50 MMSCFD, at nitrogen product of 5736 lb.moles/hr., at 2 ppm oxygen purity, ambient conditions of; 14.7 psia, 29° C. and 60% relative humidity, and product pressure at 213 psia.

The present invention has been set forth with regard to a specific preferred embodiment, but those skilled in the art will recognize obvious variations which are deemed to be within the scope of the invention, which scope should be ascertained from the claims which follow.

We claim:

1. A process for the separation of air by cryogenic distillation of the air in a distillation column comprising the steps of:

(a) compressing a feed air stream to an elevated pressure and aftercooling the pressurized air stream;
(b) removing water and carbon dioxide from the cooled pressurized air stream;
(c) splitting the feed air stream into two substreams;
(d) cooling a first substream in heat exchange against other process streams before introducing it into a distillation column;
(e) compressing a second substream and cooling it in heat exchange against other process streams;
(f) expanding the cooled, compressed, second substream in an expander to recover work, and further cooling the expanded substream;
(g) reboiling the distillation column with the expanded second substream before reducing the pressure of the substream and introducing it into the column;
(h) separating a nitrogen product stream and an oxygen-enriched stream from said distillation column;
(i) condensing a portion of the nitrogen product stream against the oxygen-enriched stream and returning it to the column as reflux;
(j) rewarming the remaining nitrogen product stream by heat exchange against process streams and compressing at least a portion of the product stream to an elevated pressure;
(k) splitting a nitrogen recycle stream from the compressed nitrogen product stream, cooling it against process streams, and compressing it further; and
(l) reboiling the distillation column with the nitrogen recycle stream before reducing it in pressure and introducing it into the column as reflux.

2. The process of claim 1 wherein the oxygen-enriched stream is removed from the column condenser and rewarmed in heat exchange against process streams.

3. The process of claim 1 wherein the feed air stream is passed through a molecular sieve adsorbent bed to remove residual water and carbon dioxide.

4. The process of claim 3 wherein at least part of the oxygen enriched product stream is used to regenerate the molecular sieve adsorbent bed.

5. The process of claim 1 wherein the oxygen-enriched stream is removed from the bottom of the distillation column, cooled by heat exchange against process streams and then reduced in temperature and pressure before being supplied to the condenser of the distillation column.

6. The process of claim 1 wherein the work recovered in step (f) is used to provide the compression requirements of step (k).

7. A process for the separation of air by cryogenic distillation of the air in a distillation column comprising the steps of:

(a) compressing a feed air stream to an elevated pressure and aftercooling the pressurized air stream;
(b) removing water and carbon dioxide from the cooled pressurized air stream;
(c) splitting the feed air stream into two substreams;
(d) cooling a first substream in heat exchange against other process streams before introducing it into a distillation column;
(e) compressing a second substream and cooling it in heat exchange against process streams;

(f) expanding the cooled, compressed, second substream in an expander to recover work, further cooling the expanded substream;

(g) reboiling the distillation column with the expanded second substream before reducing the pressure of the substream and introducing it into the column;

(h) separating a nitrogen product stream and an oxygen-enriched stream from said distillation column;

(i) condensing a portion of the nitrogen product stream against the oxygen-enriched stream and returning it to the column as reflux;

(j) rewarming the remaining nitrogen product stream by heat exchange against process streams and compressing at least a portion of the product stream to an elevated pressure;

(k) splitting two nitrogen recycle streams from the compressed nitrogen product stream;

(l) cooling the first nitrogen recycle stream in heat exchange with process streams;

(m) reboiling the distillation column with the cooled first nitrogen recycle stream;

(n) further compressing and cooling the second nitrogen recycle stream;

(o) reboiling the distillation column with the second nitrogen recycle stream in an additional reboiler and reducing it in pressure; and (p) combining the first nitrogen recycle stream and the second nitrogen recycle stream before reducing the combined stream in pressure and introducing it into the column as reflux.

8. The process of claim 7 wherein the oxygen-enriched stream is removed from the column condenser and rewarmed in heat exchange against process streams.

9. The process of claim 7 wherein the feed air stream is passed through a molecular sieve adsorbent bed to remove residual water and carbon dioxide.

10. The process of claim 9 wherein at least part of the oxygen enriched product stream is used to regenerate the molecular sieve adsorbent bed.

11. The process of claim 7 wherein the oxygen-enriched stream is removed from the bottom of the distillation column, cooled by heat exchange against process stream and then reduced in temperature and pressure before being supplied to the condenser of the distillation column.

12. The process of claim 7 wherein the work recovered in step (f) is used to provide the compression requirements of step (n).

13. A process for the separation of air by cryogenic distillation of the air in a distillation column comprising the steps of:

(a) compressing a feed air stream to an elevated pressure and aftercooling the pressurized air stream;

(b) removing water and carbon dioxide from the cooled pressurized air stream;

(c) splitting the feed air stream into two substreams;

(d) cooling a first substream in heat exchange against other process streams;

(e) compressing a second substream and cooling it in heat exchange against process streams;

(f) expanding the cooled, compressed, second substream in an expander to recover work, further cooling the expanded substream;

(g) combining the cooled, expanded second feed air substream with the first feed air stream and introducing the combined stream into the column;

(h) separating a nitrogen product stream and an oxygen-enriched stream from said distillation column;

(i) condensing a portion of the nitrogen product stream against the oxygen-enriched stream and returning it to the column as reflux;

(j) rewarming the remaining nitrogen product stream by heat exchange against process streams and compressing at least a portion of the product stream to an elevated pressure;

(k) splitting two nitrogen recycle streams from the compressed nitrogen product stream;

(l) cooling the first nitrogen recycle stream in heat exchange with process streams;

(m) reboiling the distillation column with the cooled first nitrogen recycle stream;

(n) further compressing and cooling the second nitrogen recycle stream;

(o) reboiling the distillation column with the second nitrogen recycle stream in an additional reboiler and reducing it in pressure; and (p) combining the first nitrogen recycle stream and the second nitrogen recycle stream before reducing the combined stream in pressure and introducing it into the column as reflux.

14. The process of claim 13 wherein the oxygen-enriched stream is removed from the column condenser and rewarmed in heat exchange against process streams.

15. The process of claim 13 wherein the feed air stream is passed through a molecular sieve adsorbent bed to remove residual water and carbon dioxide.

16. The process of claim 15 wherein at least part of the oxygen enriched product stream is used to regenerate the molecular sieve adsorbent bed.

17. The process of claim 13 wherein the oxygen-enriched stream is removed from the bottom of the distillation column, cooled by heat exchange against process streams and then reduced in temperature and pressure before being supplied to the condenser of the distillation column.

18. The process of claim 13 wherein the work recovered in step (f) is used to provide the compression requirements of step (n).

* * * * *